US006592636B1

(12) United States Patent
Joyce

(10) Patent No.: US 6,592,636 B1
(45) Date of Patent: Jul. 15, 2003

(54) FLOW CONTROL WITHIN A PRESS FABRIC USING BATT FIBER FUSION METHODS

(75) Inventor: Michael J. Joyce, Clifton Park, NY (US)

(73) Assignee: Albany International Corp., Albany, NY (US)

( * ) Notice: Subject to any disclaimer, the term of this patent is extended or adjusted under 35 U.S.C. 154(b) by 133 days.

(21) Appl. No.: 09/724,236

(22) Filed: Nov. 28, 2000

(51) Int. Cl.[7] ..... D21F 3/00; D21H 17/00

(52) U.S. Cl. ..... 44/1; 162/358.2; 162/358.4; 162/900; 162/901; 162/902; 162/904; 162/109; 162/110; 162/112; 162/113; 162/114; 162/117; 139/383.9; 139/425.9; 139/42

(58) Field of Search ..... 162/358.2, 358.4, 162/900–904, 109–117; 139/383.9, 425.9, 42

(56) References Cited

U.S. PATENT DOCUMENTS

| | | | |
|---|---|---|---|
| 3,840,429 | A | 10/1974 | Busker et al. |
| 4,199,401 | A | 4/1980 | Liu et al. |
| 4,588,475 | A | 5/1986 | Lundstrom |
| 5,182,164 | A | 1/1993 | Eklund et al. |
| 5,204,171 | A | 4/1993 | Eschmann |
| 5,232,768 | A | 8/1993 | Eklund et al. |
| 5,372,876 | A | 12/1994 | Johnson et al. |
| 6,140,260 | A | 10/2000 | Johnson et al. |

FOREIGN PATENT DOCUMENTS

| | | |
|---|---|---|
| DE | 297 06 427 U1 | 7/1997 |
| EP | 1 085 126 A1 | 3/2001 |

*Primary Examiner*—Elizabeth M. Cole
*Assistant Examiner*—Alexis Wachtel
(74) *Attorney, Agent, or Firm*—Frommer Lawrence & Haug, LLP; Ronald R. Santucci

(57) ABSTRACT

The present invention is directed to a press fabric having an anti-rewet scrim or "barrier" within the internal structure of a press fabric, and a method for making same. External materials are not necessary in creating the barrier. In other words, the existing material is modified to create a natural barrier to prevent water migration back to the press fabric surface.

12 Claims, 1 Drawing Sheet

FLOW CONTROL WITHIN A PRESS FABRIC USING BATT FIBER FUSION METHODS

FIELD OF THE INVENTION

The present invention is directed to the field of papermaker's fabrics, particularly, a press fabric having an anti rewet barrier.

BACKGROUND OF THE INVENTION

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fiberous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multfilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a papermachine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

When the paper sheet together with one or several press fabrics is carried into the press nip, the water from the paper sheet is forced into the press fabrics surface batt, and continues through the fabric into the void volume of the base fabric. Some water is displaced through the backside of the press fabric into the void on the surface of a press roll. Some water also flows forwards or backwards in the lengthwise direction (machine direction or MD) inside the press fabric. The relationship between these flow directions depends e.g. on the speed of the machine and on the design of the fabric and its ability to handle the water removed from the sheet.

Several theories have been put forward about what occurs in the paper sheet and press fabric as they pass together through the press nip. The exerted nip pressure is the same for both paper sheet and press fabric, while on the other hand the hydrodynamic pressure is considerably higher in the sheet than in the press fabric. This pressure difference provides the driving force for the transportation of the water from the sheet to and through the press fabric.

The minimum thickness of the sheet and the press fabric probably occurs at the same time and near mid nip. The sheet is considered to reach its maximum dry content at the very same moment. After that, the expansion is beginning in the sheet as well as in the press fabric. During this expansion a vacuum is created in the paper sheet and in the surface layer of the press fabric, both of which have been compressed to a minimum thickness. Available water is flowing back from the inside and base layers of the press fabric to the surface layer of the press fabric and further into the sheet to re-establish the pressure balance. This phase provides the driving force for the rewetting phenomenon of the paper sheet.

In the prior art press fabric constructions it is common practice to form the press fabric with a considerably denser surface layer facing the paper web relative to the backside structure and it has not been unusual to use lengthwise oriented batt fiber on the paper sheet surface of the press fabric. Considerable water still remains within the press fabric and can be reabsorbed back into the wet paper sheet as the mechanical pressure on the sheet/press fabric lessens after mid-nip. As the sheet and press fabric expand (regain thickness), a vacuum is created in both the press fabric and paper sheet. This vacuum will be larger in the paper sheet than in the press fabric creating a two phase flow of air and water into the press fabric and from the press fabric into the paper sheet. At this stage, there are three possible mechanisms that can contribute to rewetting: the pressure differential created between the press fabric and paper sheet due to expansion; film splitting produced when the paper sheet and press fabric separate outside the press nip exit; and capillary transfer of water between the paper and press fabric.

According to theory, rewetting is minimized by high resistance to interfacial seepage. This means that structures with small capillaries (holes/voids) are preferable.

Some prior art attempts at solving the rewet problem are shown in the following references:

U.S. Pat. No. 5,372,876 describes a papermaking felt with a hydrophobic layer. The felt consists of a base fabric, a flow control layer, and upper and lower batt layers. The control layer is treated with a hydrophobic chemical composition.

U.S. Pat. No. 5,232,768 describes a dewatering wet press fabric. The press fabric comprises a surface layer of high fluid flow resistance. The barrier is formed of additional fibers, filaments, foam, etc., added to the press fabric structure.

U.S. Pat. No. 5,204, 171 describes a press fabric that comprises a support fabric, a first layer of non-woven fibers stitched to the support fabric, a blocking layer of flat filaments deposited on the first layer, and a second layer of non-woven fibers deposited on the blocking layer and stitched to the press felt.

U.S. Pat. No. 4,199,401 describes a press fabric that includes a fibrous outer layer comprising a batt of coarse fibers, a fibrous underlayer comprising a batt of relatively fine fibers secured to the outer layer, and reinforcing base fabric. A difference of at least 5.0 denier exists between the fiber measurements of the coarse and fine fibers.

U.S. Pat. No. 3,840,429 describes the use of an anti-rewet membrane to retard or control the transfer of water between the press fabric and the paper. The membrane passes through the press nip between the press fabric and the paper. The membrane is hydrophobic to prevent the return of water from the press fabric to the sheet, and the press fabric is hydrophilic to aid in retaining the water.

U.S. Pat. No. 4,588,475 describes the use of a mat to reduce the rewetting of a paper web after passing through the press nip. The mat is passed through the nip with one surface in contact with the paper web and other surface in contact with a press roll.

SUMMARY OF THE INVENTION

The present invention is directed to a press fabric having an anti-rewet scrim or "barrier" within the internal structure of a press fabric, and a method for making same. Advantageously, external materials are not necessary in creating the barrier. In other words, the existing fiber batt is modified to create a natural barrier to prevent water migration back to the press fabric and surface and consequently to the paper sheet. The press fabric, however, can be in part treated with hydrophilic coating.

BRIEF DESCRIPTION OF THE DRAWINGS

Thus by the present invention its objects and advantages will be realized the description of which should be taken in conjunction with the drawing wherein.

DETAILED DESCRIPTION OF THE PREFERRED EMBODIMENT

Figure 1:
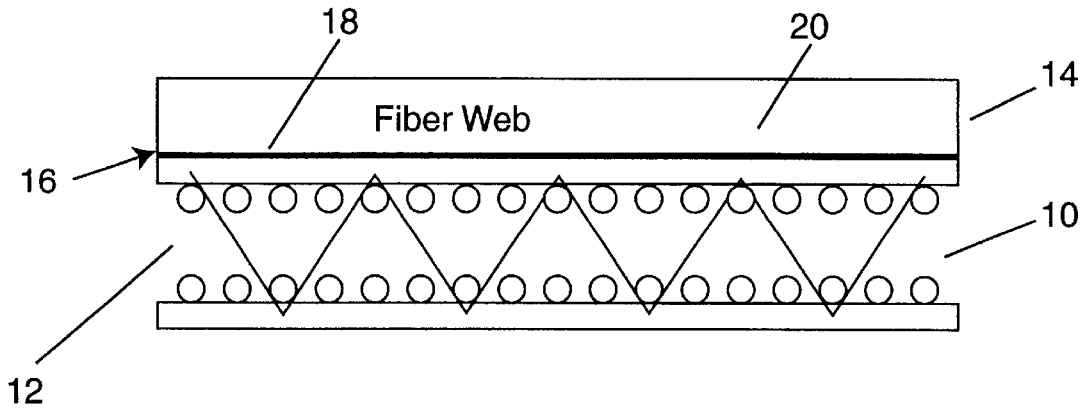
FIG. 1 is a perspective view of the press fabric of the present invention.

The manufacture of the press fabric of the present invention utilizes calendering technology. During the manufacture process, layers of staple fiber batt which may be made of polyamide, polyester, polyolefin or other material suitable for purpose, are applied and needled into the base fabric. After needling a number of batt applications, such as two or three, the fabric is subjected to a calendering process where the fiber batt is subjected to high temperatures above the melting point of the polymer material from which the fiber is made and an immediate cool-down. Compression in the calender nip can also be used. After the calendering, the fibers of the fibrous batt are flattened and glazed with very small pores (voids/holes) and almost zero permeability to air creating what will be the anti-rewet barrier of the finished press fabric. The energy applied and the pressure in the calender nip are controlled such that only the upper most surface of the fibrous batt is fused, or the entire batt present at this stage is fused. After completing the calendering processs, a hydrophilic treatment or coating is applied to the barrier layer. Subsequently, additional layers of batt material, in the form of staple fibers is applied and needled into the press fabric on top of this anti-rewet layer. Batt can also be applied to the backside of the base support structure of the press fabric.

FIG. 1 shows the press fabric 10 of the present invention. Base layer 12 is shown as a woven fabric, and can be formed by any means known to the skilled artisan. Fibrous batt 14 is attached to the base layer by needling. Fibrous batt 14 is in actuality constructed of a plurality of carded layers of batt staple fiber which has been needled to the base fabric.

Within the interior of the fibrous batt 14, fibrous barrier layer 16 is formed. This layer is formed by the above noted technique, i.e., by calendering fibrous batt 14. A hydrophilic treatment, such as a hydrophilic coating or treatment 18 may optionally be applied to the fused barrier layer 16 preferably by spraying, or any other means suitable for purpose. Other coatings may be applied as well. Additional layers of fibrous batt 20 are applied by needling subsequent to the calendering of the fibrous batt 14.

The fabric described above has a flow resistant barrier to prevent the passage of water from the material of the press fabric structure to its surface layer where it would contribute to rewetting of the paper sheet. Under maximum press load (mid-nip), the nip pressure will drive water out of the fiber batt, the calendered fused barrier layer, and into the voids of the base layer. After passing through the mid-nip of the press, the pressure is reduced. Normally, this would cause some water migration back to the press fabric surface, rewetting the paper web. However, the fused barrier layer within the press fabric prevents this from occurring by slowing or preferably preventing water flow back to the press fabric surface. Also, where a hydrophilic treatment is present, it will attract the water and further reduce the water flow towards the press fabric surface.

The barrier layer is located anywhere within the fabric structure so that the press fabric's anti-rewet property is optimized.

An alternate method of making the aforedescribed press fabric 10 can be as follows. Heretofore it is known to construct an endless "belt" of batt fiber separate from the support base structure. This "belt" of batt would then be slipped over the endless support base and attached thereto by needling across its full width. In the present invention, however, prior to attaching the "belt" of batt, it is fused as aforesaid such that its surface or the entire structure is fused. This then may be subject to hydrophilic treatment and thereafter attached to the support base structure by needling with an additional full width of batt applied thereover to complete the press fabric 10.

An advantage of this approach is that it avoids subjecting the support base structure to heat and calendering which may damage it or dimensionally change it. In addition, treating the fused "belt" of batt with a hydrophilic treatment separately, may be done in a more controlled fashion and avoids interrupting the needling process.

Thus by the present invention, its objects and advantages are realized and although a preferred embodiment is disclosed and described in detail, its scope should not be limited thereby. Rather, its scope should be determined by that of the claims.

What is claimed is:

1. A press fabric having an anti-rewet barrier comprising:

a base support structure;

a layer of batt attached to the base support structure; and a fused layer which acts as a anti-rewet barrier under said layer of batt.

2. A press fabric having an anti-rewet barrier comprising:

a base support structure;

a layer of batt attached to the base support structure;

said layer of batt comprising a fused layer which acts as a anti-rewet barrier; and at least one additional layer of batt attached to the fused layer.

3. The press fabric of claim 1 wherein the fused layer is comprised of at least one layer of batt made of a polymer material.

4. The press fabric of claim 3 wherein at least one additional layer of batt is applied over the fused layer.

5. The press fabric of claim 1 wherein the fused layer is treated or coated such that it is hydrophilic.

6. The press fabric of claim 2 wherein the fused layer is treated or coated such that it is hydrophilic.

7. The press fabric of claim 3 wherein the fused layer is treated or coated such that it is hydrophilic.

8. The press fabric of claim 4 wherein the fused layer is treated or coated such that it is hydrophilic.

9. A press fabric having an anti-rewet barrier comprising:

a base support structure;

a layer of batt attached to the base support structure;

said layer of batt comprising a fused layer which acts as a anti-rewet barrier;

at least one additional layer of batt is applied over the fused layer; and the fused layer is comprised of at least one layer of batt made of a polymer material.

10. The press fabric of claim 9 wherein the fused layer is treated or coated such that it is hydrophilic.

11. A press fabric having an anti-rewet barrier comprising:

a base support structure;

a layer of batt attached to the base support structure;

said layer of batt comprising a fused layer which acts as a anti-rewet barrier; and wherein the fused layer is treated or coated such that it is hydrophilic.

12. A press fabric having an anti-rewet barrier comprising:

a base support structure;

a layer of batt attached to the base support structure;

said layer of batt comprising a fused layer which acts as a anti-rewet barrier;

said fused layer is comprised of at least one layer of batt made of a polymer material; and wherein the fused layer is treated or coated such that it is hydrophilic.

* * * * *